US011680567B1

(12) United States Patent
Zhang et al.

(10) Patent No.: US 11,680,567 B1
(45) Date of Patent: Jun. 20, 2023

(54) HYDRAULIC GEAR PUMP WITH AXIAL COMPENSATION

(71) Applicant: Parker-Hannifin Corporation, Cleveland, OH (US)

(72) Inventors: Hao Zhang, Twinsburg, OH (US); Satish Kumar Raju Kalidindi, Mayfield Heights, OH (US); Frank Iannizzaro, Canfield, OH (US); Yu-Sen Chu, Westlake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 134 days.

(21) Appl. No.: 16/951,512

(22) Filed: Nov. 18, 2020

Related U.S. Application Data

(60) Provisional application No. 62/982,307, filed on Feb. 27, 2020.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 27/00*** | (2006.01) |
| ***F04C 2/10*** | (2006.01) |
| ***F04C 15/00*** | (2006.01) |
| *F04C 23/00* | (2006.01) |

(52) U.S. Cl.
CPC ..... *F04C 27/006* (2013.01); *F04C 2/101* (2013.01); *F04C 15/0026* (2013.01); *F04C 23/008* (2013.01)

(58) Field of Classification Search
CPC ..... F04C 2/084; F04C 2/101; F04C 15/0023; F04C 15/0026; F04C 15/003; F04C 18/103; F04C 23/008; F04C 27/005; F04C 27/006; F16J 15/02; F16J 15/06; F16J 15/10
See application file for complete search history.

(56) References Cited

U.S. PATENT DOCUMENTS

| | | | | |
|---|---|---|---|---|
| 4,830,592 A * | 5/1989 | Weidhaas | ..... | F04C 15/0026 418/132 |
| 5,022,837 A * | 6/1991 | King | ..... | F04C 15/0026 418/132 |
| 9,945,377 B2 | 4/2018 | Pippes et al. | | |

FOREIGN PATENT DOCUMENTS

| | | | | |
|---|---|---|---|---|
| CN | 102400907 A | 4/2012 | | |
| CN | 107725357 A | 2/2018 | | |
| DE | 202012104839 U | 3/2013 | | |
| EP | 1701038 A2 | 9/2006 | | |
| GB | 2575987 A * | 2/2020 | ..... | F04C 27/005 |

* cited by examiner

*Primary Examiner* — Theresa Trieu
(74) *Attorney, Agent, or Firm* — McDonnell Boehnen Hulbert & Berghoff LLP

(57) ABSTRACT

An example assembly comprises: a pump cover; a thrust plate configured to interface with the pump cover at a first side of the thrust plate and interface with gears of a gear pump at a second side of the thrust plate; and a seal disposed within a seal cavity formed at an interface between the thrust plate and the pump cover, wherein the seal defines multiple partitions at the interface between the thrust plate and the pump cover and seals each partition of the multiple partitions from other partitions.

17 Claims, 7 Drawing Sheets

HYDRAULIC GEAR PUMP WITH AXIAL COMPENSATION

CROSS REFERENCE TO RELATED APPLICATION

The present application claims priority to U.S. Provisional patent application No. 62/982,307 filed on Feb. 27, 2020, and entitled "Hydraulic Gear Pump with Axial Compensation," the entire contents of which are herein incorporated by reference as if fully set forth in this description.

BACKGROUND

A gear pump uses the meshing of gears to pump fluid by displacement. There are two main variations: external gear pumps, which use two external spur gears, and internal gear pumps, which use an external (e.g., pinion) and internal (e.g., ring) spur gears. Gear pumps have fixed displacement, where the pump can provide a constant amount of fluid for each revolution.

As the gears of the pump rotate, their teeth separate on the intake side of the pump, creating a void and suction, and the void is then filled by fluid. The fluid is carried by the gears to the discharge or outlet side of the pump, where the meshing of the gears displaces the fluid.

Suction and discharge ports interface where the gears mesh. As such, some pockets or chambers formed between the meshing gear teeth interface with the suction port having low pressure fluid, while other pockets or chambers formed between the meshing gear teeth interface with the discharge port with high pressure fluid. It may be desirable to isolate or seal chambers with high pressure or displaced fluid from chambers with low pressure fluid to prevent leakage therebetween, as leakage may reduce efficiency and performance of the pump. It may also be desirable to have a configuration where components of the gear pump can adjust their axial position to squeeze against each other and eliminate axial clearances that might cause internal leakage.

Further, in examples, multiple pressure levels can exist within the gear pump as teeth have different degrees of meshing or separation from other teeth based on their rotary position. It may thus be desirable to have a gear pump with a configuration that can isolate multiple pressure levels therein during operation to reduce the likelihood of occurrence of internal leakage and improve efficiency. It is with respect to these and other considerations that the disclosure made herein is presented.

SUMMARY

The present disclosure describes implementations that relate to a hydraulic gear pump with axial compensation.

In a first example implementation, the present disclosure describes an assembly. The assembly includes: (i) a pump cover; (ii) a thrust plate interfacing with the pump cover at a first side of the thrust plate and configured to interface with gears of a gear pump at a second side of the thrust plate; and (iii) a seal disposed within a seal cavity formed at an interface between the thrust plate and the pump cover, wherein the seal defines multiple partitions at the interface between the thrust plate and the pump cover and seals each partition of the multiple partitions from other partitions.

In a second example implementation, the present disclosure describes a gear pump. The gear pump includes: a pump ring gear; a pump pinion disposed within the pump ring gear, such that external teeth of the pump pinion are configured to engage with internal teeth of the pump ring gear; and an assembly disposed at a proximal side of the pump ring gear and the pump pinion. The assembly comprises: (i) a pump cover; (ii) a thrust plate interfacing with the pump cover at a proximal side of the thrust plate and interfacing with of the proximal side of the pump ring gear and the pump pinion at a distal side of the thrust plate; and (iii) a seal disposed within a seal cavity formed at an interface between the thrust plate and the pump cover, wherein the seal defines multiple partitions at the interface between the thrust plate and the pump cover and seals each partition of the multiple partitions from other partitions.

In a third example implementation, the present disclosure describes a method. The method includes: (i) positioning a seal within a seal cavity formed in a thrust plate or in a pump cover of a gear pump, wherein the seal defines multiple partitions at an interface between the thrust plate and the pump cover and seals each partition of the multiple partitions from other partitions; (ii) inserting a locating pin in a cavity formed in the pump cover, such that the locating pin protrudes axially from the pump cover, wherein the thrust plate includes a locating pin through-hole; and (iii) mounting the thrust plate to the pump cover such that the seal is disposed therebetween, and the locating pin passes through the locating pin-through-hole of the thrust plate.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

The present disclosure relates to using thrust plates of a gear pump as axial compensators configured to maintain contact with a pump pinion and pump ring gear to eliminate axial clearances and reduce internal leakages. The disclosed gear pump further includes seal configurations that can isolate multiple pressure levels within the gear pump from each other and effectively seal high pressure chambers form low pressure chambers. The seal configurations are further configured to block or reduce leakage in both directions (from an intake chamber to a discharge chamber, and vice versa), thus enabling the gear pump to be bi-directional. In a bi-directional pump having a first port and a second port, either port can be an inlet port or an outlet port, and the pump can thus drive a hydraulic actuator in two opposite directions. The pump can also operate in a regenerative mode, i.e., can operate as a motor.

Figure 1:
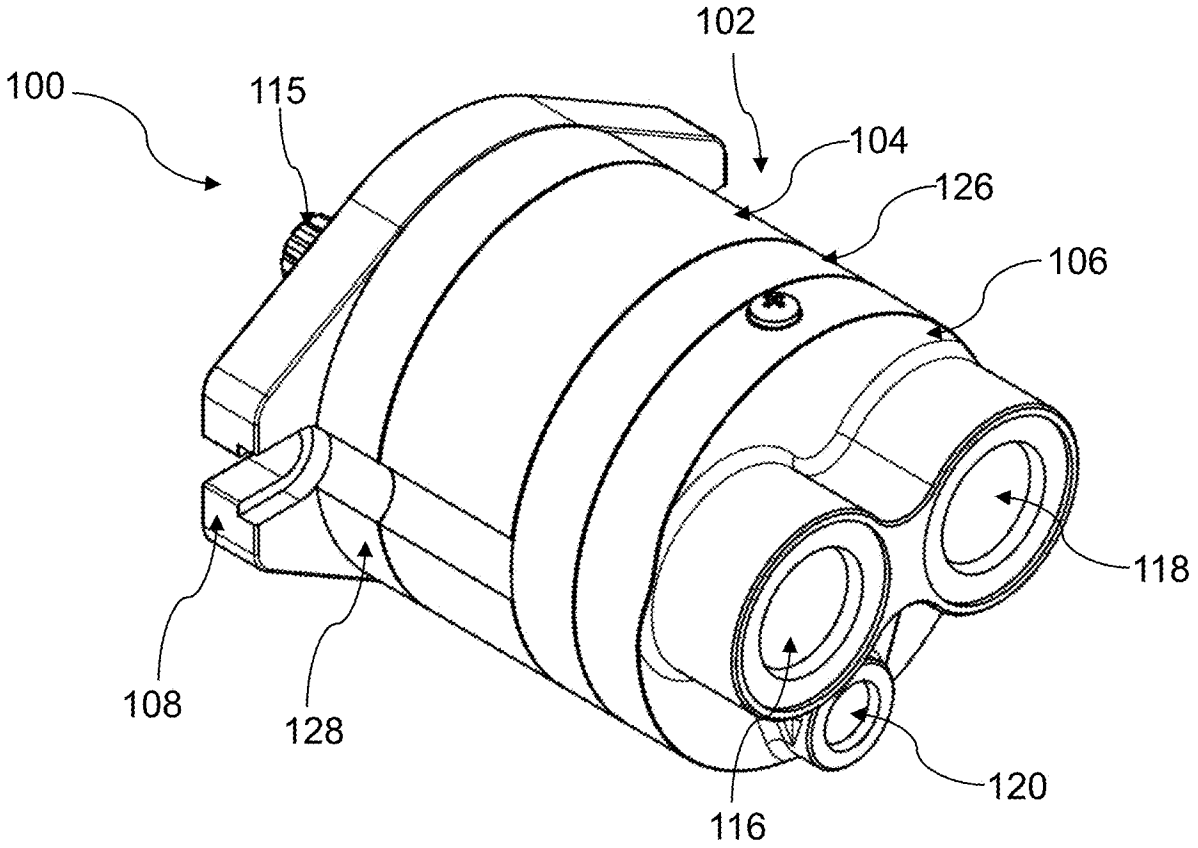
FIG. 1 illustrates a perspective view of an assembly, in accordance with an example implementation.
Figure 2:
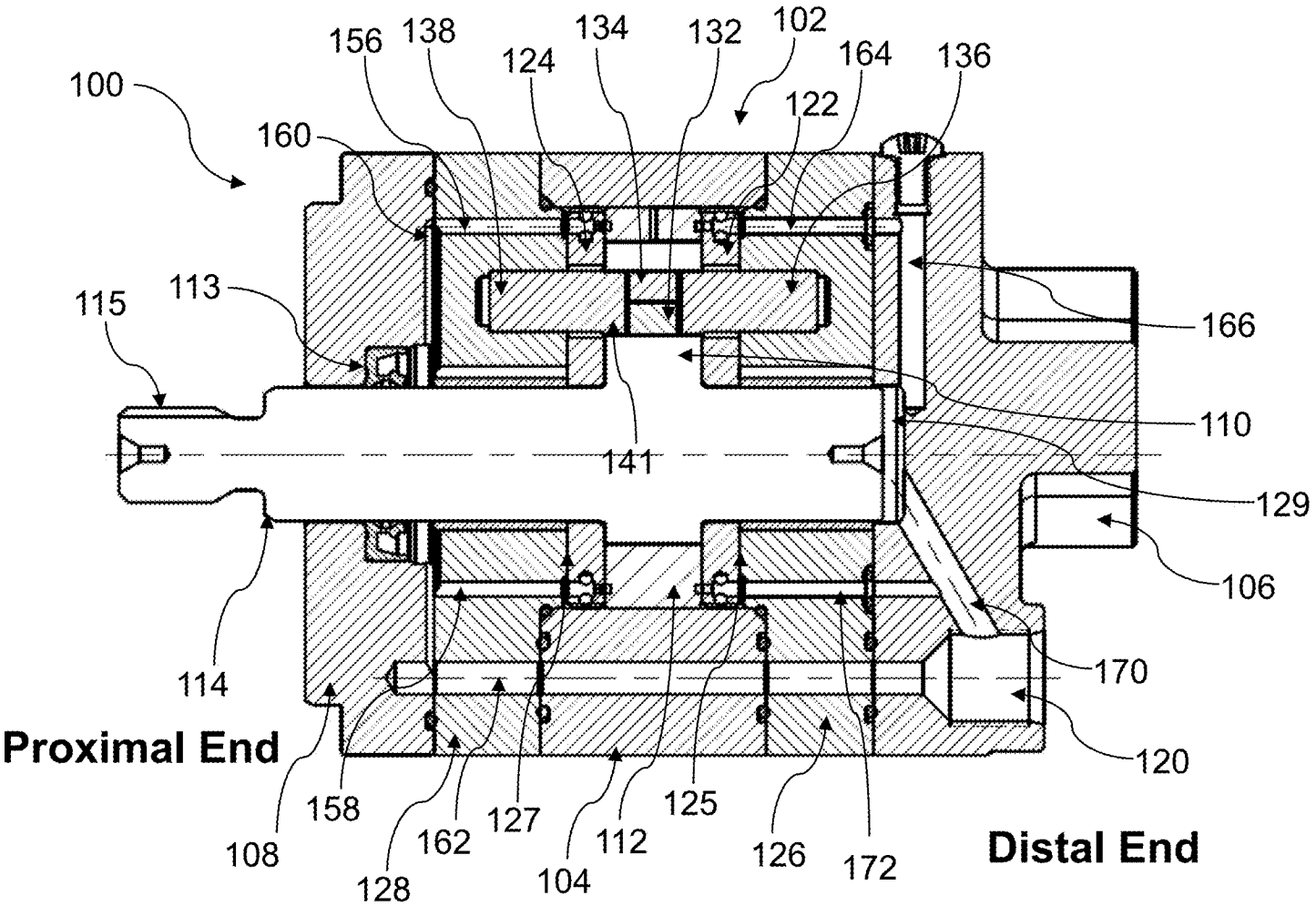
FIG. 2 illustrates a cross-sectional side view of the assembly of FIG. 1, in accordance with an example implementation.
Figure 3:
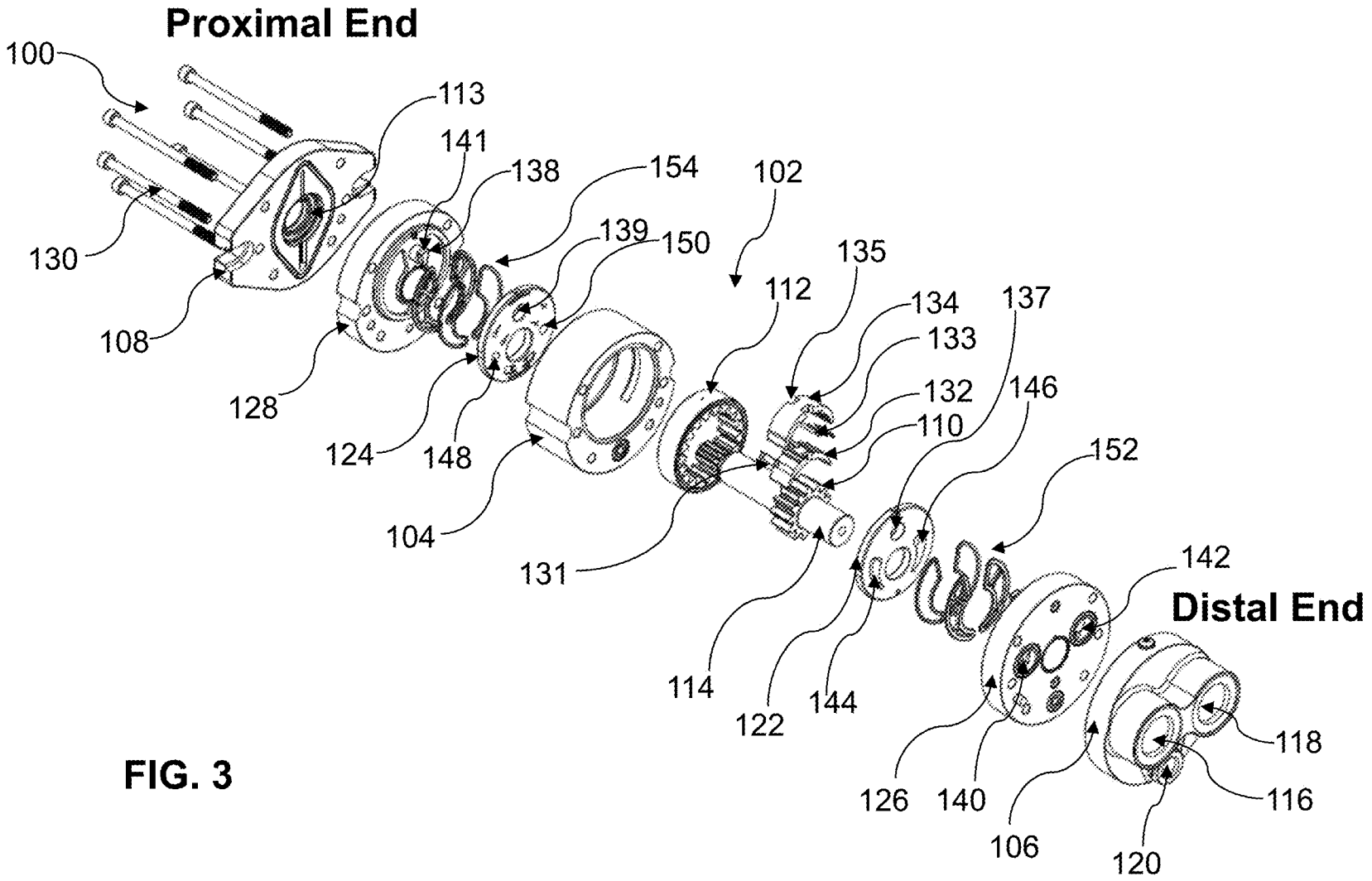
FIG. 3 illustrates a perspective exploded view of the assembly of FIG. 1, in accordance with an example implementation.

FIG. 1 illustrates a perspective view of an assembly 100, FIG. 2 illustrates a cross-sectional side view of the assembly 100, and FIG. 3 illustrates a perspective exploded view of the assembly 100, in accordance with an example implementation. FIGS. 1-3 are described together.

The assembly 100 comprises a gear pump 102 having a pump housing 104 configured to house components of the gear pump 102. The gear pump 102 is mounted or interposed between a first end cover 106 and a second end cover 108 of the assembly 100.

As shown in FIGS. 2-3, the gear pump 102 is configured as an internal gear pump having a pump pinion 110 (e.g., a spur gear having external teeth formed in an exterior peripheral surface thereof) and a pump ring gear 112 (e.g., ring gear having internal teeth formed in an interior peripheral surface thereof) disposed within the pump housing 104. As depicted in FIGS. 2-3, the pump pinion 110 is mounted to, or is an integral portion of, a pump shaft 114, and the teeth of the pump pinion 110 engage with the teeth of the pump ring gear 112. Further, the pump pinion 110 is mounted off-center relative to the pump ring gear 112, i.e., a center of rotation of the pump pinion 110 is eccentric relative to or offset from a center of rotation of the pump ring gear 112.

The pump shaft 114 is supported within the assembly 100 via a bearing 113 disposed within the second end cover 108 to allow the pump shaft 114 to rotate relative to the second end cover 108. In examples, the pump shaft 114 can be rotatably coupled to a gearbox or a rotor of an electric motor via splines 115 to provide rotary motion to the pump pinion 110 and the pump ring gear 112 via the pump shaft 114.

As shown in FIGS. 1, 3, the first end cover 106 can have a first port 116 and a second port 118. The first end cover 106 further has a drain port 120.

The gear pump 102 is configured to operate as a bi-directional pump. Particularly, the first port 116 can operate as an inlet port configured to receive fluid from a fluid reservoir fluidly coupled to the assembly 100 (e.g., via a hose of any hydraulic line), and the second port 118 can operate as an outlet or discharge port for providing pressurized fluid being discharged from the gear pump 102 to a hydraulic consumer, e.g., an hydraulic actuator, fluidly coupled to the assembly 100. The hydraulic actuator can, for example, by a hydraulic cylinder having a piston linearly moving therein or can be a hydraulic motor. In this mode of operation, the pump pinion 110 and the pump ring gear 112 rotate in a first rotational direction and the hydraulic actuator can move in a first direction.

In another mode of operation, the first port 116 can operate as a discharge port for providing pressurized fluid being discharged from the gear pump 102 to the hydraulic actuator, and the second port 118 can operate as an inlet port configured to receive fluid from the fluid reservoir. In this mode of operation, the pump pinion 110 and the pump ring gear 112 rotate in a second rotational direction opposite the first rotational direction, and the hydraulic actuator can move in a second direction opposite the first direction.

The pump ring gear 112 and the pump pinion 110 are supported axially within the pump housing 104 via a first thrust plate 122 disposed on distal sides of the pump ring gear 112 and the pump pinion 110 and a second thrust plate 124 on the proximal sides of the pump ring gear 112 and the pump pinion 110. As such, the pump pinion 110 and the pump ring gear 112 are interposed or sandwiched between the thrust plates 122, 124. As described below, the thrust plates 122, 124 can operate as axial compensator that can reduce the leakage within the gear pump 102 and improve its efficiency.

The thrust plates 122, 124 are in turn supported by a first pump cover 126 and a second pump cover 128. Particularly, the thrust plate 122 interfaces with the pump cover 126 at an interface 125, and the thrust plate 124 interfaces with the pump cover 128 at an interface 127. The term "interface" is used herein to indicate a point, plane, or space (or a portion of the plane or space) where two components meet and interact (e.g., where the thrust plates 122, 124 meet and interact with the pump covers 126, 128, respectively).

As illustrated by FIGS. 2-3, the first pump cover 126 interfaces with the first end cover 106. Similarly, the second pump cover 128 interfaces with the second end cover 108. The first end cover 106, the first pump cover 126, the second pump cover 128, and the second end cover 108 have fastener through-holes disposed in a circular array, such that a plurality of fasteners or bolts 130 (e.g., socket head bolts) can be used to couple them axially together in a tight axial assembly. As such, the first end cover 106, the first pump cover 126, the second pump cover 128, and the second end cover 108 and components of the gear pump 102 disposed therebetween can be aligned and stacked, then bolted together using the bolts 130.

With this configuration, components of the gear pump 102 are interposed between and supported by pump covers 126, 128, which in turn are supported by the end covers 106, 108. As depicted in FIG. 2, the second end cover 108, the pump covers 126, 128, and the thrust plates 122, 124 include respective central through-holes to accommodate the pump shaft 114 therethrough. The first end cover 106 has a cavity 129 in which the distal end of the pump shaft 114 is disposed. The thrust plates 122, 124 are not bolted with the bolts 130, but are rather configured as floating components that can move axially as described below to make up for any axial clearances and reduce internal leakage within the gear pump 102.

Operating of the gear pump 102 is described next assuming it rotates in a given direction; however, it should be understood that the gear pump 102 can operate in the other direction as well where the operation of the ports and fluid volumes is reversed.

During operation, as the pump shaft 114 rotates, the pump pinion 110 rotates within the pump ring gear 112. As the external gear teeth of the pump pinion 110 and the internal gear teeth of the pump ring gear 112 separate or disengage, they create an expanding volume (i.e., expanding chamber). The expanding volume collectively represents multiple pockets formed between the separating teeth. The expanding volume operates as a suction void forming between the separating teeth on the intake side of the gear pump 102 that is fluidly coupled to the inlet port (e.g., the first port 116). Fluid from the inlet port thus fills the expanding volume between the teeth.

The fluid is carried by the gear teeth of the pump pinion 110 and the pump ring gear 112 to another chamber or volume on a discharge side of the gear pump 102, which is fluidly coupled to the outlet port (e.g., the second port 118). The meshing of the gear teeth of the pump pinion 110 and the pump ring gear 112 displaces the fluid, and the fluid is then provided to the outlet port. As such, as the teeth of the pump pinion 110 and the pump ring gear 112 become interlocked on the discharge side of the gear pump 102, the volume is reduced and the fluid is forced out under pressure.

As the teeth of the pump pinion 110 and the pump ring gear 112 mesh, they form a seal between the expanding volume having low pressure fluid received from the inlet port and the volume between teeth that are meshing or are about to mesh coupled to the discharge or outlet port. The seal created by the meshed teeth forces the fluid out of the discharge port and prevents fluid from flowing back toward the inlet port.

Further, as shown in FIGS. 2-3, the gear pump 102 includes an inner crescent 132 and an upper or outer crescent 134. The terms "inner" and "outer" indicate radial positioning of the crescents, where the inner crescent 132 is disposed radially inward relative to the outer crescent 134.

The inner crescent 132 and the outer crescent 134 are axially supported within the internal space between the pump ring gear 112 and the pump pinion 110 by a first locating pin 136 and a second locating pin 138 depicted in FIG. 2 (the locating pin 138 is also shown in FIG. 3). As shown in FIG. 2, the locating pin 136 is disposed partially in a blind hole or cavity formed in the first pump cover 126 and extends through a locating pin through-hole 137 in the thrust plate 122 to axially interface with distal ends of the crescents 132, 134. Similarly, the locating pin 138 is disposed partially in a blind hole or cavity formed in the second pump cover 128 and extends through a locating pin through-hole 139 in the thrust plate 124 to axially interface with proximal ends of the crescents 132, 134.

With this configuration, the inner crescent 132 and the outer crescent 134 are held axially in position by the locating pins 136, 138, and the locating pins 136, 138 also maintain the orientation of the crescents 132, 134. In other words, the locating pins 136, 138 support the inner crescent 132 and the outer crescent 134 in an axial direction.

As the pump pinion 110 and the pump ring gear 112 rotate during operation of the gear pump 102, the crescents 132, 134 divide the fluid as it is being carried from the low pressure suction expanding volume to the volume coupled to the discharge port. Thus, the crescents 132, 134 can form a seal between the low pressure volume and the high pressure volume.

Particularly, the outer surface (i.e., radially outward surface) of the outer crescent 134 interfaces with the inner teeth of the pump ring gear 112 to create a seal therebetween. An effective seal between the outer surface of the outer crescent 134 and the inner teeth of the pump ring gear 112 may preclude leakage from the high pressure volume to the low pressure volume. The terms "preclude" or "block" fluid flow is used herein to indicate substantially preventing fluid flow except for minimal flow of drops per minute, for example.

In a similar manner, the inner surface (i.e., radially inward surface) of the inner crescent 132 interfaces with the external teeth of the pump pinion 110 to create a seal therebetween. An effective seal between the inner surface of the inner crescent 132 and the external teeth of the pump pinion 110 may preclude leakage from the high pressure volume to the low pressure volume.

The configuration of a crescent seal assembly of the crescents 132, 134 provides for an effective seal and compensates for radial clearances between the crescents 132, 134 and the gear teeth to create an effective seal. Particularly, fluid from either the expanding volume or the high pressure volume seeping through the interface between the outer crescent 134 and the inner crescent 132 can push the crescents 132, 134 radially apart. The fluid between the crescents 132, 134 can then push the outer crescent 134 radially outward toward the inner teeth of the pump ring gear 112, thereby eliminating any radial space or clearance therebetween and forming an effective seal. Similarly, the fluid between the crescents 132, 134 can push the inner crescent 132 radially inward toward the external teeth of the pump pinion 110, thereby eliminating any radial space or clearance therebetween and forming an effective seal.

Further, the crescents 132, 134 can be configured such that at least one spring cavity is formed therebetween. The spring cavities can be formed as recesses in the inner surface of the outer crescent 134. In other example implementations, the spring cavities can be formed as recesses in the outer surface of the inner crescent 132. In another example, both the inner crescent 132 and the outer crescent 134 can have mating or facing recesses that form the spring cavities therebetween.

The spring cavities can receive springs therein such as leaf spring 131 shown in FIG. 3. In addition to fluid pushing the crescents 132, 134 radially apart, the leaf spring 131 disposed in the spring cavity can also push the crescents 132, 134 radially apart. With this configuration, the leaf spring 131 can push the outer crescent 134 radially outward toward the inner teeth of the pump ring gear 112, thereby enhancing effectiveness of the seal therebetween. Similarly, the leaf spring 131 can push the inner crescent 132 radially inward toward the external teeth of the pump pinion 110, thereby enhancing effectiveness of the seal therebetween. A leaf spring is used herein as an example biasing element. Other types of springs can be used, such as wave springs or coil springs.

Further, the crescent seal assembly can include check valves between the crescents 132, 134 to preclude fluid flow from the high pressure volume to the low pressure volume regardless of the direction of rotation of the pump shaft 114. In particular, the outer crescent 134 and the inner crescent 132 can have recesses or grooves that form check valve cavities or recesses therebetween. Check pins such as check pin 133 shown in FIG. 3 can be positioned in the check valve cavities.

Pressurized fluid seeping between the crescents 132, 134 from a high pressure volume to a low pressure volume pushes the check pin 133 against the surfaces of the crescents 132, 134, which form a seat for the check pin. The check pin 133 thus creates a seal with the surfaces of crescents and precludes leakage thereacross. Another oppositely disposed check pin and check valve cavity can preclude or block leakage in the other direction when the pump shaft 114 rotates in the other direction.

This configuration of the crescent seal assembly enables the gear pump 102 to be bi-directional. Whether fluid is drawn through the first port 116 then displaced to the second port 118, or vice versa, the check pins operate as opposite check valves that block leakage fluid flow in either direction. Additional check pins can be added to further enhance the seal between the intake side and the discharge side of the gear pump 102.

Referring to FIG. 3, the outer crescent 134 can have a recess 135 formed in a proximal end face of the outer crescent 134 at a vertex of the outer crescent 134. In an example, the recess 135 can have a generally trapezoidal cross section. Similarly, the inner crescent 132 can have a corresponding recess in a respective proximal end face of the inner crescent 132 at a respective vertex of the inner crescent 132.

Together, the recess 135 and the recess in the inner crescent 132 form a depression that having a generally trapezoidal cross-sectional shape with curved bases. The distal end faces of the crescents 132, 134 also have a similar configuration with a similar depression.

The locating pins 136, 138 described above can have generally cylindrical bodies with ends having a shape that matches the trapezoidal shape of the depression formed by the recesses. For example, as shown in FIG. 3, the locating pin 138 can have an end 141 that is received within the depression to interface with the crescents 132, 134 and support them axially. As such, the end 141 of the locating pin 138 has a shape that can be received within the depression. The locating pin 136 can be configured in a similar manner.

As shown in FIG. 3, on the distal side of the pump pinion 110 and the pump ring gear 112, the first pump cover 126 can have through-hole 140 and through-hole 142 corresponding to and aligned with the first port 116 and the second port 118, respectively, to allow for fluid communication through the first pump cover 126. Similarly, the thrust plate 122 has a through-hole 144 and through-hole 146 that are generally kidney shaped and allow for fluid communication therethrough.

On the proximal side of the pump pinion 110 and the pump ring gear 112, the thrust plate 124 has multiple through-holes, such as through-hole 148, through-hole 150, among others, that allow for fluid communication therethrough. Fluid in the expanding volume and the high pressure volume formed between the pump pinion 110 and the pump ring gear 112 can thus be communicated axially in both directions via the through-holes in the thrust plates 122, 124. Fluid thus reaches the interfaces 125, 127 between the thrust plates 122, 124 and the pump covers 126, 128, respectively.

Fluid trapped at the interface 125 between the thrust plate 122 and the first pump cover 126 applies an axial fluid force on the thrust plate 122 toward distal end faces of the pump pinion 110 and the pump ring gear 112. This way, a metal-to-metal seal is created between the thrust plate 122 and the distal end faces of the pump pinion 110 and the pump ring gear 112. Similarly, fluid trapped at the interface 127 between the thrust plate 124 and the second pump cover 128 applies an axial fluid force on the thrust plate 124 toward proximal end faces of the pump pinion 110 and the pump ring gear 112. This way, a metal-to-metal seal is created between the thrust plate 124 and the proximal end faces of the pump pinion 110 and the pump ring gear 112.

The fluid forces acting on the thrust plates 122, 124 toward the pump pinion 110 and the pump ring gear 112 pushes or squeezes the thrust plates 122, 124 axially against the pump pinion 110 and the pump ring gear 112, thereby creating an effective seal and eliminating any axial gaps therebetween. As such, the thrust plates 122, 124 can be referred to as axial compensators as they can compensate for any axial gaps between the thrust plates 122, 124 and the pump pinion 110 and the pump ring gear 112 disposed therebetween, thereby reducing leakage and improving efficiency of the gear pump 102.

Referring to FIG. 3, the gear pump 102 can include a first set of seals such as first set of kidney-shaped seals 152 that can be disposed in contoured cavities or recesses in a proximal side of the pump cover 126, where the recesses have a shape matching the shape of the first set of kidney-shaped seals 152. Thus, the first set of kidney-shaped seals 152 can be placed on the proximal side of the first pump cover 126 facing the thrust plate 122. With this configuration, the first set of kidney-shaped seals 152 isolate or seal high pressure fluid (from the high pressure volume) communicated to the interface 125 between the thrust plate 122 and the first pump cover 126 from low pressure fluid (from the expanding volume) communicated to the interface 125 between the thrust plate 122 and the pump cover 126. The first set of kidney-shaped seals 152 may thus preclude cross-flow or leakage from the high pressure side to the low pressure side.

Similarly, the gear pump 102 can include a second set of seals such as second set of kidney-shaped seals 154 disposed in contoured cavities or recesses in a distal side of the pump cover 128, where the recesses have a shape matching the shape of the second set of kidney-shaped seals 154. Thus, the second set of kidney-shaped seals 154 is placed on the distal side of the second pump cover 128 facing the thrust plate 124. The second set of kidney-shaped seals 154 may isolate or seal high pressure fluid (from the high pressure volume) communicated to the interface 127 between the thrust plate 124 and the second pump cover 128 from low pressure fluid (from the expanding volume) communicated to the interface 127 between the thrust plate 124 and the second pump cover 128. The second set of kidney-shaped seals 154 may thus precludes cross-flow or leakage from the high pressure side to the low pressure side.

Referring back to FIG. 2, the second pump cover 128 can have longitudinal channel 156 and longitudinal channel 158 that can communicate fluid at the interface 127 between the second pump cover 128 and the thrust plate 124 to a cavity or recess 160 in the second end cover 108. The recess 160 in turn is fluidly coupled to the drain port 120 through a drain passage 162 to drain any high pressure fluid that reaches the second end cover 108 to reduce internal pressure within the gear pump 102.

Similarly, the first pump cover 126 can have longitudinal channel 164 that can communicate fluid to a radial channel 166, which in turn is fluidly coupled to the cavity 129 in the first end cover 106. The cavity 129 in turn is fluidly coupled to the drain port 120 through a drain passage 170 to drain any high pressure fluid that reaches the first end cover 106 and reduce internal pressure within the gear pump 102. Further, the first pump cover 126 can include another longitudinal channel 172 that can communicate fluid to the drain passage 170, which is fluidly coupled to the drain port 120, to drain any high pressure fluid that reaches the first end cover 106 and reduce internal pressure within the gear pump 102.

As mentioned above, as external teeth of the pump pinion 110 separate from internal teeth of the pump ring gear 112 on the intake side of the gear pump 102, an expanding volume is created with low pressure. On the discharge side of the gear pump 102, as external teeth of the pump pinion 110 mesh with the internal teeth of the pump ring gear 112, a decreasing volume causes fluid to be forced out under pressure.

The teeth of the pump pinion 110 and the pump ring gear 112 can be at various degrees of separation or meshing based on their rotational position. Some teeth may be completely meshed, others may be contacting each other but not completely meshed, and other may be about to mesh. Pressure pockets created between the teeth at various stages of gear meshing can have different pressure levels. In other words, multiple pressure levels may exist within the gear pump 102 (e.g., between the pump ring gear 112 and the pump pinion 110). Consequently, multiple pressure levels can exist in at the interface 125 between the first pump cover 126 and the thrust plate 122, and the interface 127 between the second pump cover 128 and the thrust plate 124. In this case, it may be desirable to isolate the multiple pressure levels from each other to reduce internal leakage in the gear pump 102 and improve its efficiency.

Figure 5:
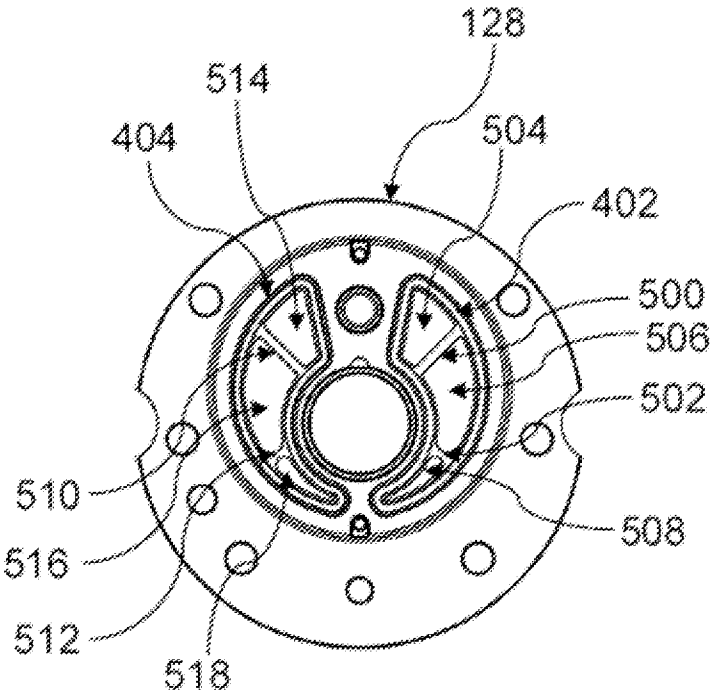
FIG. 5 illustrates a front view of the pump cover and the set of kidney-shaped seals shown in FIG. 4, in accordance with an example implementation.
Figure 4:
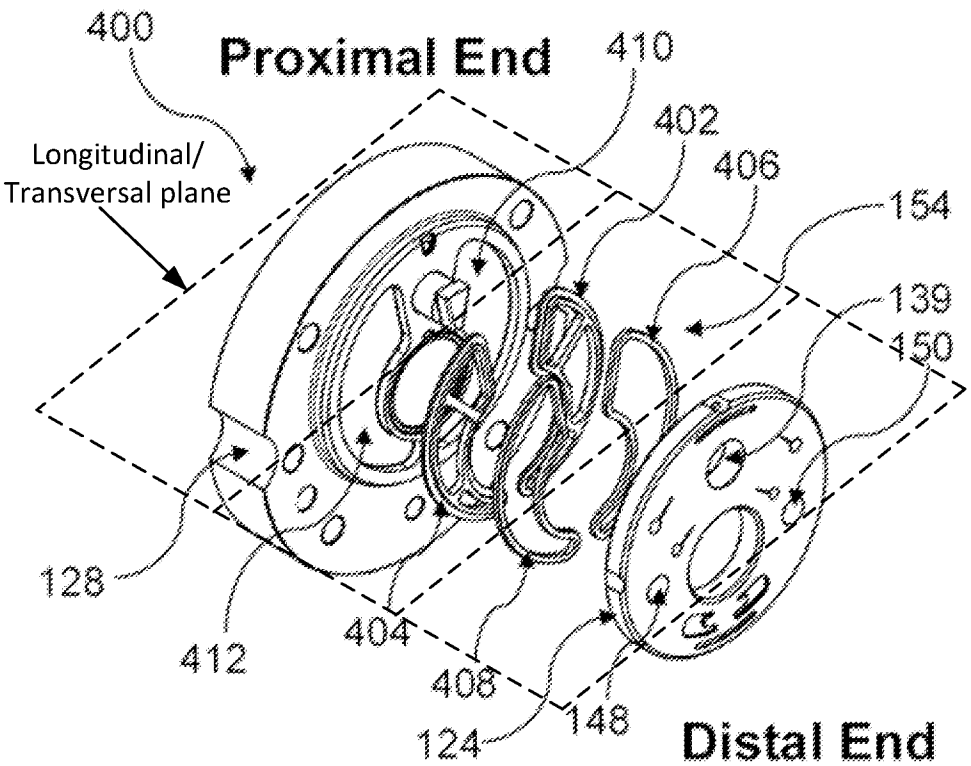
FIG. 4 illustrates a perspective view of a partial assembly of a gear pump showing a pump cover, a thrust plate, and a set of kidney-shaped seals, in accordance with an example implementation.

FIG. 4 illustrates a perspective view of a partial assembly 400 of the gear pump 102 showing the second pump cover 128, the thrust plate 124, and the second set of kidney-shaped seals 154, and FIG. 5 illustrates a front view of the second pump cover 128 and the second set of kidney-shaped seals 154, in accordance with an example implementation. FIGS. 4 and 5 are described together.

In the example implementation of FIGS. 3-5, the second set of kidney-shaped seals 154 can include a first main seal 402, a second main seal 404, a first backup seal 406, and a second backup seal 408. The first main seal 402 and the first backup seal 406 can be positioned in a kidney-shaped seal cavity 410 in the second pump cover 128. Similarly, the second main seal 404 and the second backup seal 408 can be positioned in a kidney-shaped seal cavity 412 in the second pump cover 128.

In an example, the main seals 402, 404 can be made of an elastomeric material (e.g., rubber). In an example, the main seals 402, 404 can be configured as energized seals. For instance, the main seals 402, 404 can be configured as pressure-actuated jackets having a cup-shaped (e.g., U-shaped or V-shaped) cross section and made from polymeric seal material. In examples, the main seals 402, 404 can also include metal springs, and thus can be referred to as spring energized seals.

Such seals are compressed when installed into the kidney-shaped seal cavities 410, 412, and the resilient spring responds with constant force, pushing out the sealing lips and creating a tight seal against the sealing surfaces in the pump end cover 128. The main seals 402, 404 can thus expand as pressure is introduced, increasing the sealing force beyond that provided by the spring and the jacket material.

In examples, the main seals 402, 404 and/or the backup seals 406, 408 can have a circular cross section. In other examples, the main seals 402, 404 and/or the backup seals 406, 408 can have a rectangular or square cross section, as opposed to a circular cross section, when a cross section is taken along a longitudinal plane of the assembly 400. Seals with a square cross section have high sealing capacity as well as shape and dimensional stability, and are therefore resistant to extrusion, high pressures, and vibrations.

Additionally, the main seals 402, 404 define multiple chambers or partitions within the kidney-shaped seal cavities 410, 412, respectively. Particularly, the inner space of the main seals 402, 404 (which are generally kidney shaped) is divided into multiple partitions that correspond to the multiple pressure levels described above. For example, referring to FIG. 5, the main seal 402 can include two ribs: a first rib 500 and a second rib 502. With this configuration, the ribs 500, 502 divide the inner space of the main seal 402 (and the space within the kidney-shaped seal cavity 410) into three partitions 504, 506, and 508. Each of the partitions 504, 506, and 508 can have fluid with a respective pressure level that is different than pressure level in the other partitions and the ribs 500, 502 isolate or seal the partitions 504, 506, and 508 from each other to block leakage therebetween.

Similarly, the main seal 404 can include a first rib 510 and a second rib 512. The ribs 510, 512 divide the inner space of the main seal 404 (and the space within the kidney-shaped cavity) into three partitions 514, 516, and 518. Each of the partitions 514, 516, and 518 can have fluid with a respective pressure level that is different than pressure level in the other partitions and the ribs 510, 512 seal the partitions 514, 516, and 518 from each other to block leakage therebetween.

The backup seals 406, 408 can be made of a material different from a respective material of the main seals 402, 404. Particularly, the backup seals 406, 408 can be made of a stiff, but deformable material. For instance, the backup seals 406, 408 can be made of polyether ether ketone (PEEK), which comprises an organic thermoplastic polymer. PEEK material is characterized by flexibility and maintaining its mechanical and chemical properties at high temperatures. However, the backup seals 406, 408 can be made alternative materials (e.g., metal).

This way, the backup seal 406, 408 operate as stiffening or support members that can elongate the life of the main seals 402, 404. In other words, the backup seals 406, 408 support the main seals 402, 404 to reduce the likelihood of the main seals 402, 404 being damaged or deformed under high pressure fluid.

Further, the backup seals 406, 408 face the proximal side of the thrust plate 124. Thus, as the thrust plate 124 (which is a floating component as mentioned above) moves, it rubs against the backup seals 406, 408. By avoiding rubbing the thrust plate 124 against the elastomeric material of the main seals 402, 404, the life of the main seals 402, 404 may be elongated.

The first pump cover 126 and the first set of kidney-shaped seals 152 can be configured in a similar manner. Other seal configuration can be used to form multiple partitions and isolate multiple pressure levels within the gear pump 102.

Figure 6:
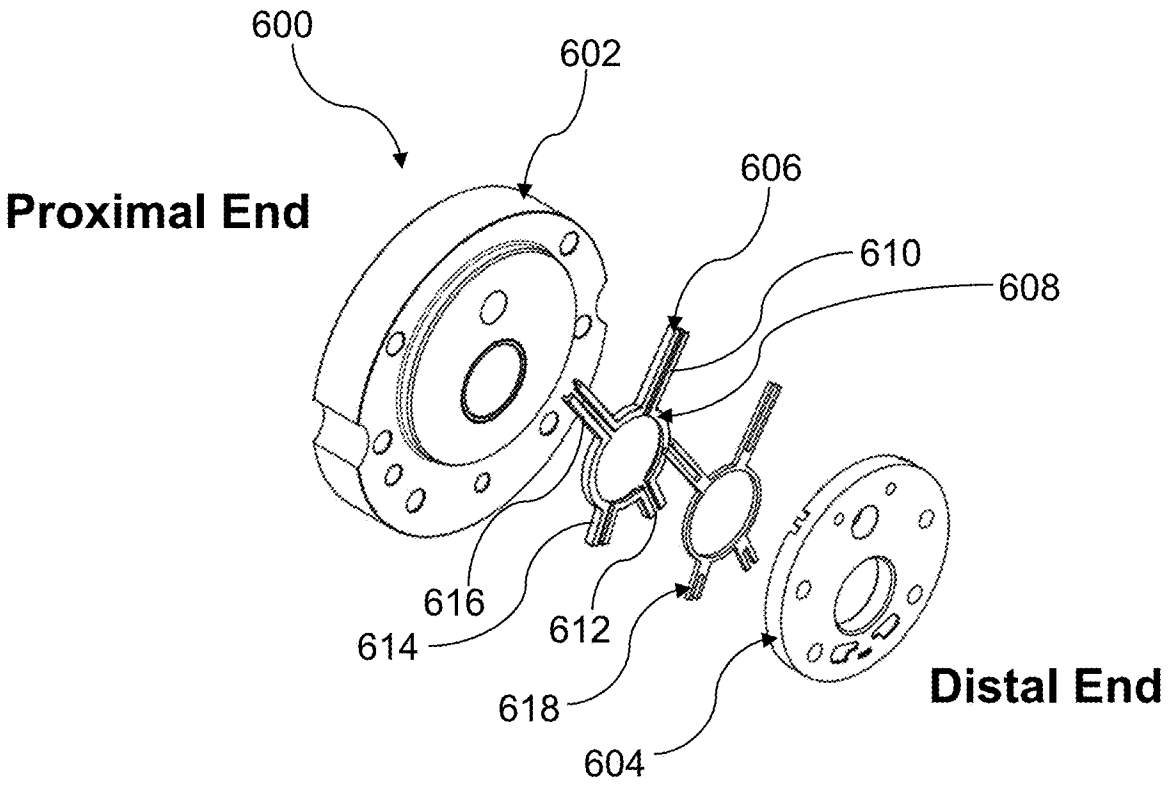
FIG. 6 illustrates a perspective view of a partial assembly of a gear pump showing a pump cover, a thrust plate, and an alternative seal configuration, in accordance with an example implementation.

FIG. 6 illustrates a perspective view of a partial assembly 600 of the gear pump 102 showing a pump cover 602, a thrust plate 604, and an alternative seal configuration, in accordance with an example implementation. In the example implementation of FIG. 6, the pump cover 602 differs from the pump cover 128 in that the seal cavity is not in the pump cover 602. Rather, the seal cavity (not shown) is formed in the proximal side of the thrust plate 604.

Further, the seal configuration in FIG. 6 is different from the seal configuration in the implementation of Figures of the 3-5. Rather than kidney-shaped seals, the assembly 600 depicts a main seal 606 configured to have a circular central portion 608 from which a plurality of legs (e.g., a plurality of radial protrusions) emanate or project radially outward. As an example, the main seal 606 can include four radial protrusions or legs: a first leg 610, a second leg 612, a third leg 614, and a fourth leg 616.

Similar the main seals 402, 404, the main seal 606 can also be made of an elastomeric material (e.g., rubber). The main seal 606 can be configured as a pressure-actuated energized seal or a spring energized seal similar to the main seals 402, 404.

For instance, the main seals 402, 404 can be configured to have cup-shaped (e.g., U-shaped or V-shaped) cross section and made from a polymeric seal material. The assembly 600 can further include a backup seal 618 that is similar to the backup seals 406, 408 but has a different shape that matches the shape of the main seal 606 with a circular central portion and a plurality of legs (e.g., four legs) emanating radially outward from the circular central portion. This way, the main seal 606 can receive the backup seal 618 therein (i.e., the backup seal 618 operates as a male component that is received in grooves of the main seal 606, which operates as a female component.

Further, similar to the main seals 402, 404, the main seal 606 and the backup seal 618 define at the interface between the pump cover 602 and the thrust plate 604 multiple isolated or sealed partitions that correspond to the multiple pressure levels described above. Particularly, the space defined between two radial protrusions, i.e., between each two legs of the legs 610-616, forms a respective partition that is isolated or sealed from the other partitions by way of the legs.

For instance, the partition formed between the legs 610, 612 is a first partition, the partition formed between the legs 612, 614 is a second partition, the partition formed between the legs 614, 616 is a third partition, and the partition formed between the legs 616, 610 is a fourth partition. Each of the four partitions can have fluid with a respective pressure level that is different than pressure level in the other partitions and the legs 610-616 isolate or seal the partitions from each other and block leakage.

The backup seal 618 can be made of a stiff but deformable material. For instance, the backup seal 618 can be made of made of PEEK. The backup seal 618 thus operates as a stiffening or support member that can elongate the life of the main seal 606. In other words, the backup seal 618 supports the main seal 606 to reduce the likelihood of the main seal 606 being damaged or deformed under high pressure fluid.

Further, the main seal 606 and the backup seal 618 are disposed in the thrust plate 604, rather than the pump cover 602. For instance, the thrust plate 604 can have grooves forming a cavity (e.g., a template) engraved in its proximal end face having the same shape as the main seal 606 so as to accommodate the main seal 606 an the backup seal 618 therein. As such, the main seal 606 and the backup seal 618 are surrounded by surfaces (e.g., metal surfaces) of the thrust plate 604, and are thus not affected directly by high pressure fluid. This way, the life of the main seals 606 and the backup seal 618 may be elongated.

In example implementations, the main seal 606 can be divided into two opposing seals, each having an arc-shaped central portion, and two straight leg portions that are angled relative to the arc-shaped central portion. In other words, the main seal 606 can be divided vertically or radially in half into two facing seals that combined can similarly isolate four partitions from each other.

Figure 7:
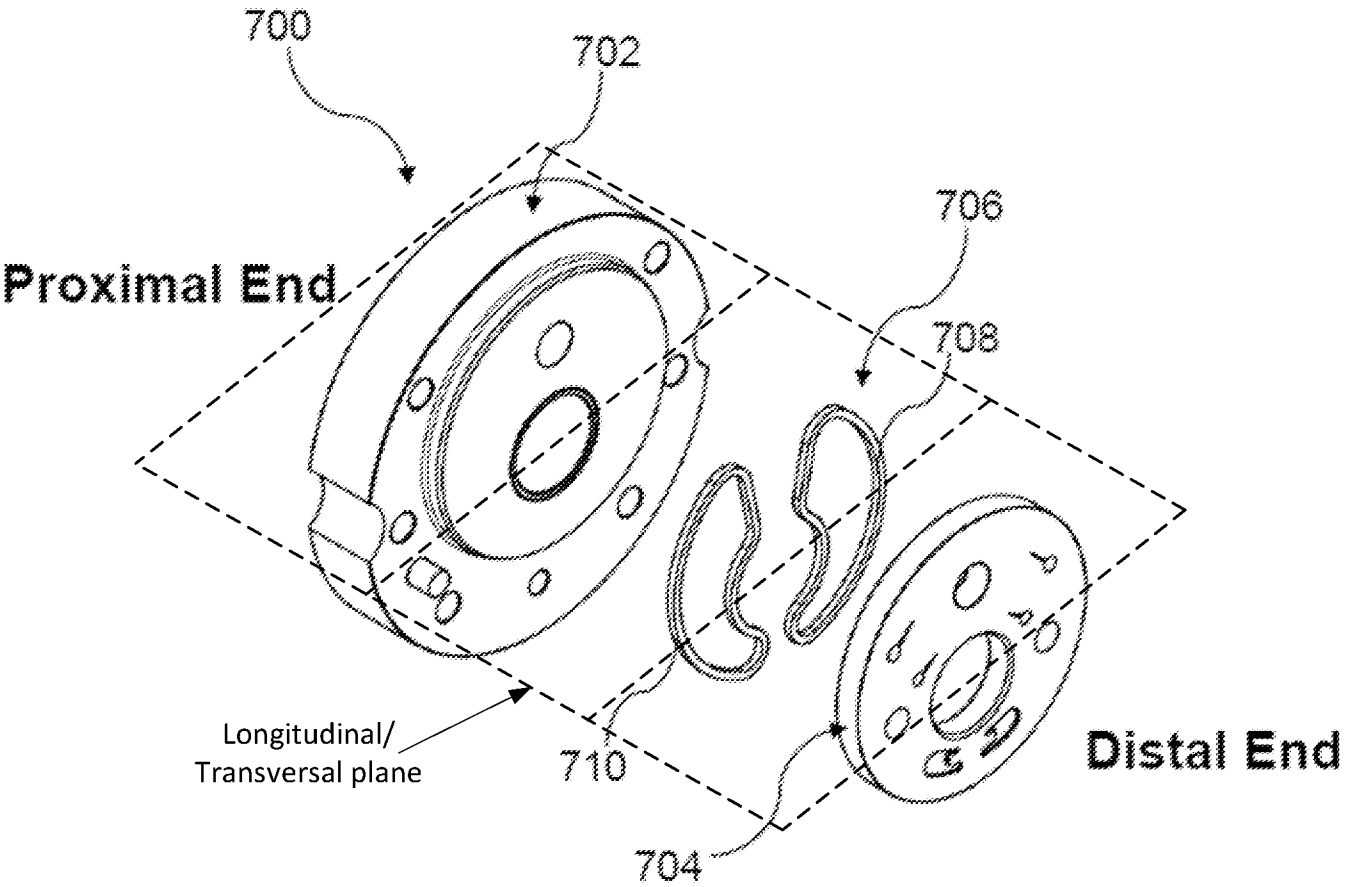
FIG. 7 illustrates a perspective view of another partial assembly of a gear pump showing a pump cover, a thrust plate, and an alternative seal configuration, in accordance with an example implementation.

FIG. 7 illustrates a perspective view of a partial assembly 700 of the gear pump 102 showing a pump cover 702, a thrust plate 704, and an alternative seal configuration, in accordance with an example implementation. In the example implementation of FIG. 7, the pump cover 702 is similar to the pump cover 602 in that it the seal cavity is not in the pump cover 702, but is rather formed in the proximal side of the thrust plate 704 that faces the pump cover 702.

Further, the assembly 700 includes an alternative seal configuration. Particularly, the assembly 700 includes one set of kidney-shaped seals 706 having a first kidney-shaped seal 708 and as second kidney-shaped seal 710. As depicted in FIG. 7, the kidney-shaped seals 708, 710 have a rectangular or square cross section as opposed to a circular cross section. Seals with a square cross section may have high sealing capacity as well as shape and dimensional stability, and may therefore be resistant to extrusion, high pressures, and vibrations.

The seal configuration of FIG. 7 does not include a backup seal made from a different material. Further, the kidney-shaped seals 708, 710 are disposed in the thrust plate 704, which is a floating component that is movable within the gear pump 102. As such, the kidney-shaped seals 708, 710 may adjust their position with the thrust plate 704 for effective sealing during operation of the gear pump 102.

Further, the kidney-shaped seals 708, 710 are disposed in a cavity engraved in the thrust plate 704, and are therefore surrounded by metal surfaces. Thus, the kidney-shaped seals 708, 710 might not directly contact or be affected by high pressure. As such, this configuration may elongate the life of the kidney-shaped seals 708, 710.

Figure 8:
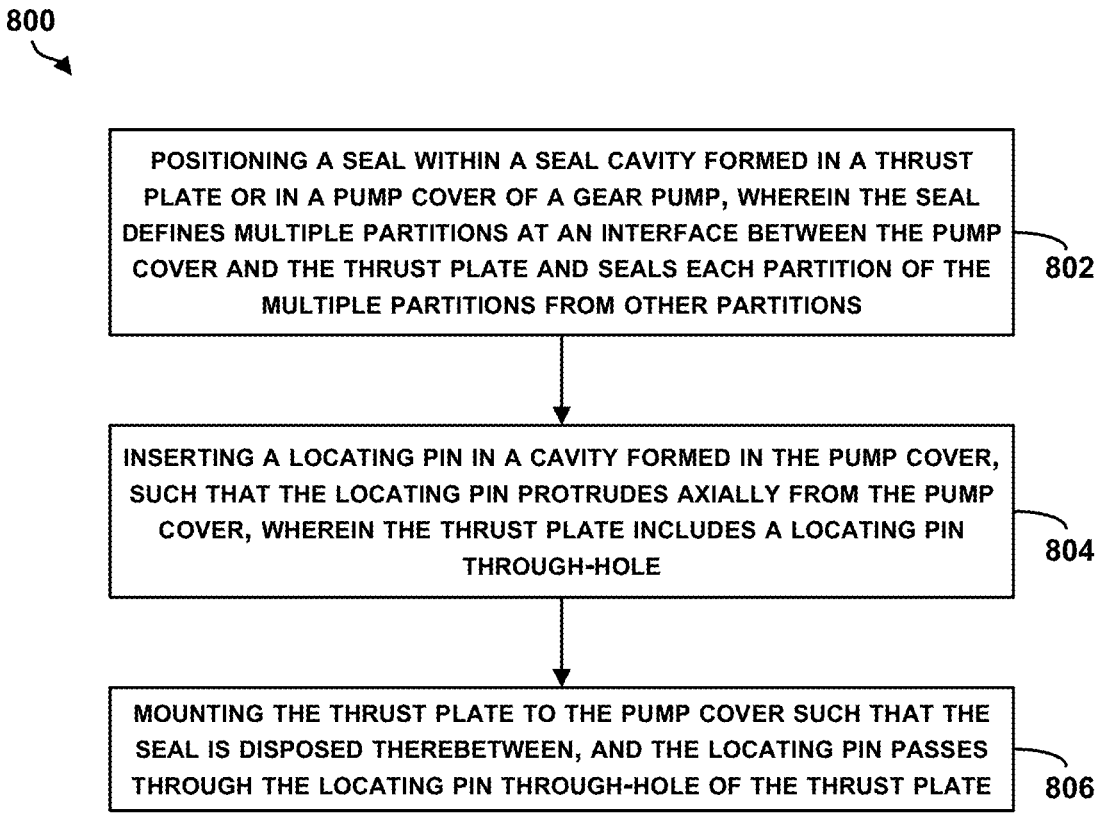
FIG. 8 is a flowchart of a method for assembling a portion of a gear pump, in accordance with an example implementation.

FIG. 8 is a flowchart of a method 800 for assembling a portion of the gear pump 102, in accordance with an example implementation. The portion of the gear pump 102 includes at least a pump cover (any of the pump covers 126, 128, 602, 702) and a thrust plate (e.g., any of the thrust plates 122, 124, 604, 704).

The method 800 may include one or more operations, functions, or actions as illustrated by one or more of blocks 802-806. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 802, the method 800 includes positioning a seal within a seal cavity formed in a thrust plate or in a pump cover of a gear pump, wherein the seal defines multiple partitions at an interface between the thrust plate and the pump cover and seals each partition of the multiple partitions from other partitions. For example, the seal can be the main seal 402, 404 or the main seal 606 configured to divide a respective seal cavity (e.g., the kidney-shaped seal cavity 410, 412) or the interface between the pump cover 602 and the thrust plate 604 into multiple partitions (e.g., the partitions 504, 506, 508, the partitions 514, 516, 518, or the partitions between the legs of the main seal 606).

At block 804, the method 800 includes inserting a locating pin in a cavity formed in the pump cover, such that the locating pin protrudes axially from the pump cover, wherein the thrust plate includes a locating pin through-hole. For example, the locating pin 138 can be mounted or inserted into the cavity in the pump cover 128 such that it protrudes axially from the pump cover as shown in FIGS. 3-4. The thrust plate 124 includes the locating pin through-hole 139.

At block 806, the method 800 includes mounting the thrust plate to the pump cover such that the seal is disposed therebetween, and the locating pin passes through the locating pin through-hole of the thrust plate. For example, the locating pin 138 can be aligned with the locating pin through-hole 139 and inserted therethrough. The thrust plate (e.g., the thrust plate 124, 604, or 708) can then be mounted to the pump cover such that they are interfacing with each other and the seal is therebetween.

The method 800 can further include other steps to assembly remaining portions of the gear pump 102, such as mounting the end cover 108, the pump housing 104, the pump shaft 114, the crescent seal assembly, the thrust plate, pump cover, and the end cover 106 on the other side of the pump ring gear 112 and the pump pinion 110, etc.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. An assembly comprising:

a pump cover;

a thrust plate interfacing with the pump cover at a first side of the thrust plate and configured to interface with gears of a gear pump at a second side of the thrust plate; and a seal disposed within a seal cavity formed at an interface between the thrust plate and the pump cover, wherein the seal defines multiple partitions at the interface between the thrust plate and the pump cover and seals each partition of the multiple partitions from other partitions, wherein the seal is kidney-shaped and has a square cross section when a cross section is taken along a longitudinal plane of the assembly.

2. The assembly of claim 1, further comprising:

a locating pin disposed in a cavity formed in the pump cover, such that the locating pin protrudes axially from the pump cover, wherein the thrust plate includes a locating pin through-hole, and wherein the locating pin extends through the locating pin through-hole and protrudes from the second side of the thrust plate.

3. The assembly of claim 1, wherein the seal cavity is formed in the pump cover, wherein the seal cavity is kidney-shaped, and wherein the kidney-shaped seal comprises one or more ribs that divide the kidney-shaped seal cavity into the multiple partitions.

4. The assembly of claim 3, wherein the kidney-shaped seal comprises two ribs dividing the kidney-shaped seal cavity into three partitions.

5. The assembly of claim 1, wherein the kidney-shaped seal is a main seal, and wherein the assembly further comprises:

a backup seal interfacing with the main seal.

6. The assembly of claim 5, wherein the backup seal has a square cross section.

7. The assembly of claim 5, wherein the backup seal is made from a material different from a respective material of the main seal.

8. The assembly of claim 1, wherein the kidney-shaped seal is disposed in a groove engraved in the thrust plate such that the kidney-shaped seal is surrounded by surfaces of the thrust plate.

9. A gear pump comprising:

a pump ring gear;

a pump pinion disposed within the pump ring gear, such that external teeth of the pump pinion are configured to engage with internal teeth of the pump ring gear; and an assembly disposed at a proximal side of the pump ring gear and the pump pinion, the assembly comprising:

a pump cover, a thrust plate interfacing with the pump cover at a proximal side of the thrust plate and interfacing with of the proximal side of the pump ring gear and the pump pinion at a distal side of the thrust plate, and a seal disposed within a seal cavity formed at an interface between the thrust plate and the pump cover, wherein the seal defines multiple partitions at the interface between the thrust plate and the pump cover and seals each partition of the multiple partitions from other partitions, wherein the seal is kidney-shaped and has a square cross section when a cross section is taken along a longitudinal plane of the gear pump.

10. The gear pump of claim 9, further comprising:

a crescent seal assembly comprising an outer crescent and an inner crescent disposed within the pump ring gear between the pump pinion and the pump ring gear; and a locating pin disposed in a cavity formed in the pump cover, such that the locating pin protrudes axially from the pump cover, wherein the thrust plate includes a locating pin through-hole, and wherein the locating pin extends through the locating pin through-hole and protrudes from the distal side of the thrust plate and interfaces with the crescent seal assembly, thereby supporting the crescent seal assembly axially.

11. The gear pump of claim 9, wherein the seal cavity is formed in the pump cover, wherein the seal and the seal cavity is kidney-shaped, and wherein the kidney-shaped seal comprises one or more ribs that divide the kidney-shaped seal cavity into the multiple partitions.

12. The gear pump of claim 9, wherein the kidney-shaped seal comprises two ribs dividing the kidney-shaped seal cavity into three partitions.

13. The gear pump of claim 9, wherein the kidney-shaped seal is a main seal, and wherein the assembly further comprises:

a backup seal interfacing with the main seal.

14. The gear pump of claim 13, wherein the backup seal has a square cross section.

15. The gear pump of claim 9, wherein the kidney-shaped seal is disposed in a groove engraved in the thrust plate such that the kidney-shaped seal is surrounded by surfaces of the thrust plate.

16. A method comprising:

positioning a seal within a seal cavity formed in a thrust plate or in a pump cover of a gear pump, wherein the seal defines multiple partitions at an interface between the thrust plate and the pump cover and seals each partition of the multiple partitions from other partitions;

inserting a locating pin in a cavity formed in the pump cover, such that the locating pin protrudes axially from the pump cover, wherein the thrust plate includes a locating pin through-hole; and mounting the thrust plate to the pump cover such that the seal is disposed therebetween, and the locating pin passes through the locating pin through-hole of the thrust plate, wherein the seal is kidney-shaped and has a square cross section when a cross section is taken along a longitudinal plane of the gear pump.

17. The method of claim 16, wherein positioning the kidney-shaped seal within the seal cavity comprises:

positioning the kidney-shaped seal in a kidney-shaped seal cavity formed in the pump cover, wherein the kidney-shaped seal comprises one or more ribs that divide the kidney-shaped seal cavity into the multiple partitions.

* * * * *